US008131138B2

(12) United States Patent
Vissa et al.

(10) Patent No.: US 8,131,138 B2
(45) Date of Patent: Mar. 6, 2012

(54) FLEXIBLE DIE HEATER

(75) Inventors: Ramgopal Vissa, Cincinnati, OH (US); Venkata Burada, West Chester, OH (US); John Carson, Williamsburg, OH (US)

(73) Assignee: Micropyretics Heaters International, Inc., Cincinnati, OH (US)

( * ) Notice: Subject to any disclaimer, the term of this patent is extended or adjusted under 35 U.S.C. 154(b) by 264 days.

(21) Appl. No.: 10/726,487

(22) Filed: Dec. 4, 2003

(65) Prior Publication Data

US 2005/0123287 A1 Jun. 9, 2005

(51) Int. Cl.
*F26B 3/30* (2006.01)
*F26B 3/10* (2006.01)

(52) U.S. Cl. ..... 392/413; 392/417

(58) Field of Classification Search ..... 392/407, 392/408, 409, 410, 411, 412, 413, 414, 415, 392/418; 165/109.1; 34/68
See application file for complete search history.

(56) References Cited

U.S. PATENT DOCUMENTS

| | | | | |
|---|---|---|---|---|
| 1,232,908 | A * | 7/1917 | Feyrer | 362/280 |
| 3,694,647 | A * | 9/1972 | Chapman et al. | 362/411 |
| 3,761,678 | A * | 9/1973 | Eckles | 392/411 |
| 3,953,100 | A * | 4/1976 | Feeney | 439/206 |
| 3,970,835 | A * | 7/1976 | Crete | 362/11 |
| 4,159,411 | A * | 6/1979 | Ellersick | 392/410 |
| 4,178,500 | A * | 12/1979 | Brindopke | 219/524 |
| 4,292,985 | A * | 10/1981 | Itogawa et al. | 132/272 |
| 4,366,411 | A * | 12/1982 | Robinson | 313/272 |
| 4,494,316 | A * | 1/1985 | Stephansen et al. | 34/68 |
| 4,907,533 | A * | 3/1990 | Nelson et al. | 118/663 |
| 5,236,160 | A * | 8/1993 | Sechelski | 248/125.1 |
| 5,533,567 | A * | 7/1996 | Van Putten et al. | 165/109.1 |
| 5,915,072 | A * | 6/1999 | Campbell et al. | 392/418 |
| 6,437,292 | B1 * | 8/2002 | Sikka et al. | 219/411 |
| 6,797,971 | B2 * | 9/2004 | Cekic et al. | 250/504 R |
| 7,021,199 | B2 * | 4/2006 | Lubowicki et al. | 99/372 |
| 2003/0076024 | A1 * | 4/2003 | Dieudonne et al. | 313/315 |
| 2004/0065658 | A1 * | 4/2004 | Damiano et al. | 219/524 |
| 2004/0252505 | A1 * | 12/2004 | Swanson | 362/257 |

OTHER PUBLICATIONS

Wikipedia definition of Incandescent light bulb.*

* cited by examiner

*Primary Examiner* — Sang Paik

(57) ABSTRACT

A novel flexible infrared device is provided for heating surfaces in a uniform manner not available previously. The heater is designed in a manner so as to allow "hugging" of the surface by attaching the heater module to at least two swivel points located above the heating plane. In this manner the common problems encountered with heating dies by IR heaters is overcome.

3 Claims, 7 Drawing Sheets

FLEXIBLE DIE HEATER

PATENT APPLICATION

Die heating is an operation which is required in several processes such as forging, extrusion, low pressure die casting, squeeze casting, glass extrusion and many more forming operations for sheet metal fabrication. The heating of the die is often the most critical start up procedure in forging, extrusion and pressure die casting operations. Improper pre-heating results in a variety of problems, the most significant being low die life on account of non-uniform temperature along the surface of the die (the primary cause for early failure or distortion from thermal fatigue).

A wide variety of thermal processing techniques are used for die heating. Most commonly, the dies are heated with one or several gas flame torches. Often, the gas torches are arranged in a manner so as to produce a distributed heat source on the die surface. The common problems encountered with this heating method are carbon deposits, high noise, very significant temperature non-uniformities and a large temperature difference between the upper and lower die surfaces in vertical configurations. There are also serious fire hazard risks associated with flame heating.

An alternative to die heating by flames is by convection or radiation (See e.g. article Simulating Convective Die Heating for Forgings and Pressure Casting, JOM, 2002 August [pp. 39-43]). Convection heating i.e. by a hot fluid such as heated air dramatically improves uniformity on account of its flexible coverage. When especially a convective source is used instead of flame the problems such as carbon deposits, noise and explosion hazard conditions are clearly eliminated. The elimination of open flames for preheating of existing hot forging dies without major retooling effort or major increases to change-over is also now recognized as being critical for safety in the overall plant as many fires have been started by open flames.

Typically die preheating for forging involves pre-heating forging dies for example on four poster presses. The forging operation involves loading pre-heated billets from nearby furnaces into the press, and hot forging multiple parts per press cycle. Gas preheating methods may comprise of multiple gas torches heating for several hours to 100° C.-500 C pre-heat temperature of the die contact surfaces. The gas preheating method is inconsistent due to varying die configuration and direct flame hot spots. Direct flame hot spots may reduce the hardness or temper of the dies leading to premature wear and replacement. In a recent report, a plant fire was started by the gas heating while employees were at lunch when a hydraulic hose burst near the open flame during unmonitored die pre-heating. The hydraulic oil was ignited by the open flame and the subsequent fire did extensive damage to the press equipment and the building. Process change is a high priority.

Crank or low pressure dies cast or forge dies generally weigh 600-6000 lbs each and are commonly made of the H13 material. Typical set-up utilizes four to six dies but location on the die plate varies across entire envelope due to wide variety of crank and cam shafts forged. Hub dies can utilize four per set-up with each die weighing 50 to 70 lbs or more.

It is well know in the art that dies may be heated with infrared heaters especially of the short wave kind. It is also well recognized in the art that convective heaters should really be used in place of infrared heaters (IR heaters) for providing the uniformity and coverage which infrared heaters are unable to give on account of line of sight heating by radiation. See FIG. 1 which illustrates convective heating and line-of-sight radiative heating. Convective heating is more uniform as the fluid is able to pass over all surfaces.

However IR heating is generally faster than convection although the convective heating technique allows flexibility and versatility to die heating especially when there are contours and bends in the die or if other die inserts prevent line-of-sight heating. If the IR heating system could be made versatile enough to provide better coverage then IR heating would become more useful. It is the object of this invention to offer such a product. It is another object of this invention to provide a flexible IR heating system. It is a further object of the invention that the flexible IR system may be used in conjunction with convective heating. It is a further object of this invention that IR heating be used in conjunction with a non ionized gas and an ionized gas (see FIG. 2). The ionized and non Ionized gas may be produced with the technique described in U.S. Pat. No. 5,963,709 (incorporated herein fully) U.S. Pat. No. 6,816,671 incorporated herein fully.

INVENTION

A foldable (flexible) system comprising of several independent but electrically connected IR units which may be connected as shown in FIG. 3 and FIG. 4. A section on the detailed description of the figures is also provided after the section on a brief description of drawings.

Note how the flexible IR (infrared) heating system provided in the manner shown in FIGS. 3 and 4 may be manipulated to change the coverage, shape and performance by manipulating the metallic flexible arms and by the 180 and 360 degree swivel (i.e. along the axis of the heater, module and heater and along the normal to the axis of the heater respectively). Note that the modules are pinned to at least one swivel point where such rotation is possible (i.e. where swiveling is allowed). Each module may also rotate 90 degrees at the flaps. In this manner complete three dimensional spaces may be radiated with an apparatus not available previously. Note in this manner "Space hugging" is possible and gives rise to space optimization.

For a demonstration of the benefit of the flexible configuration, a single module with swivel capability along the axis of the bulb axis (this is also the axis, in this example, of the longest dimension of the module) was made. An apparatus with the multi-swivel feature was then constructed and tested with several of the modules. See FIGS. 5 and 7 below which illustrate the possible heating of a surface area of a block of steel which extends beyond the heater coverage. Such heating was achieved in an uniform manner.

FIG. 6 shows how a swiveling operation of a single module may be use to heat a surface which is 90 degrees to the plane of the heater. The shaded area in the figure represents the heated area. Note that the unit itself faces a surface which is at 90° plane to the heated plane.

BEST MODE

Several best configurations and power settings are envisaged based on the application. For die heating a 600 lb block to 100 C, a 48 kW unit i.e. 24 modules of 2 kW each in the configuration of FIG. 3 is anticipated. In this manner the total usage of energy is estimated to be only 25% of that which would be required by gas heating. The dies may be used as soon as the surface is heated. In this manner energy is saved compared to gas heating which is normally of such a long duration that the die has to be completely heated and reheated which requires a substantially higher amount of energy.

Another application for the flexible heater is in the paper mill industry for drying or glazing rapidly moving paper sheets. In such use a convective heating system is also contemplated with use with the flexible IR units or incorporating flexible IR modules. A 20 kW system is anticipated.

The flexible heaters may also be used for paint removal. Here a medium wave bulb instead of a short wave bulb is preferred. For paint removing purposes from a surface about 2-4 kW medium wave IR units are contemplated.

The flexible heating system may also be used for drying asphalt and cement from a truck bed. A 50-100 kW unit is anticipated for such a purpose.

In instances where additional uniformity or rate of heating is required, the flexible IR units may be used along with other gasses and also with ionized gasses.

For die heating: Multiple infrared short wave lamps with integral reflectors attached to a scissor action adjustable frame (FIG. 3 for example) may be used in the flexible manner. Lamps can be mounted on either or both sides of the frame thus allowing even (uniform) heating on the top and bottom die halves. Lamps can be positioned for various die configurations by adjusting the clamp position to the frame and extending or contracting the frame. Fine adjustment are made utilizing the swivel feature on lamp clamping mechanism allowing bilateral 30° adjustment from the horizontal plane of the die face. This function allows quicker heating of the target areas without wasting energy for heating unused portions of the die block. The correct feature size allows individual lamps to be switched off or removed from the frame to insure the most economical heating solution for each die configuration within the operating range of the frame model. This solution is a versatile open structure, without an enclosure or side panels, allowing dies of different sizes to be heated with the same equipment thus reducing overall tooling costs.

Equipment may be a direct plug in to the available line voltage without the need for expensive controls. An optional temperature feedback system may be used utilizing thermocouples for precise monitoring of die temperatures.

Other applications are possible such as in liquid phase joining where flexibility could be a benefit (typical example, C. A. Blue et al., Metallurgical and Materials Transactions A, Volume 27 A, pg 1-8, 1996) or for heat treatment of complex parts (typical example J. R. Davis, in Aluminum and Aluminum Alloys ASM Specialty Handbook, 1993)

BRIEF DESCRIPTION OF THE DRAWINGS

While the specification concludes with claims particularly pointing out and distinctly claiming the present invention, it is believed that the same will be better understood from the following description taken in conjunction with the accompanying drawings and the detailed description of drawings which follows this section.

More detailed description of the drawings now follows.

DETAILED DESCRIPTION OF FIGURES

Figure 1:
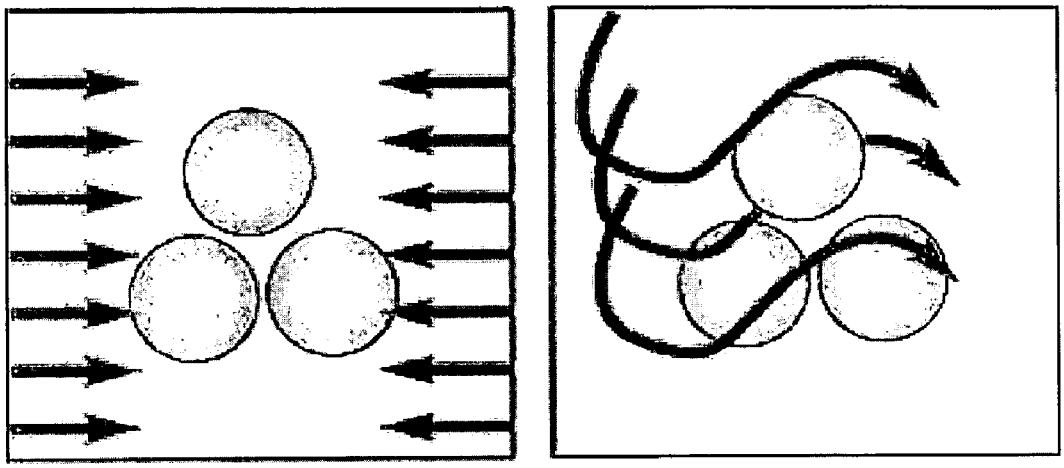
FIG. 1 shows a convective heating illustration and the illustration of a line-of-sight radiative heating schematic.
Figure 2:
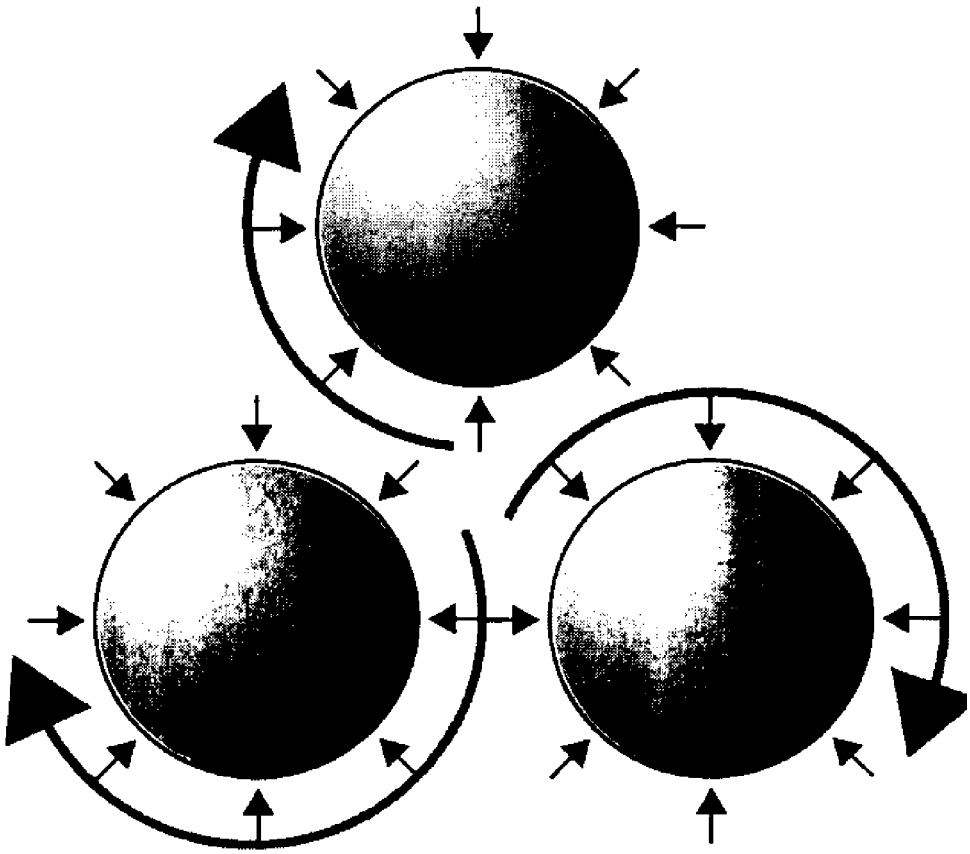
FIG. 2 shows the concept of extra heat deposition (i.e. over convection) by ionized gas. Such an ionized gas is provided by example by the apparatus of U.S. Pat. No. 6,816,671 incorporated herein.

FIGS. 1 and 2 are illustrative of concept of radiative heating and convective heating by gas and ionized medium in the gas respectively. The circles in both figures represent objects placed in the heating furnace. In FIG. 1 the straight arrows represent line of sight radiation and the curved arrows represent convention. In FIG. 2 the long curvy arrows represent convection and the short arrows represent heat deposition from ions. Radiative heating is a line of sight heating (normally fast) and convective heating is slow unless very high velocity jets are used. The use of such jets would preclude large area coverage. The presence of ionization assists convective heating but it is difficult to have a large concentrations in normal atmosphere pressures as ions easily recombine with free electrons. This is the basis of the invention i.e. a flexible IR system which can be used to eliminate the non-uniformity and provide rapid optimized heating.

Figure 3:
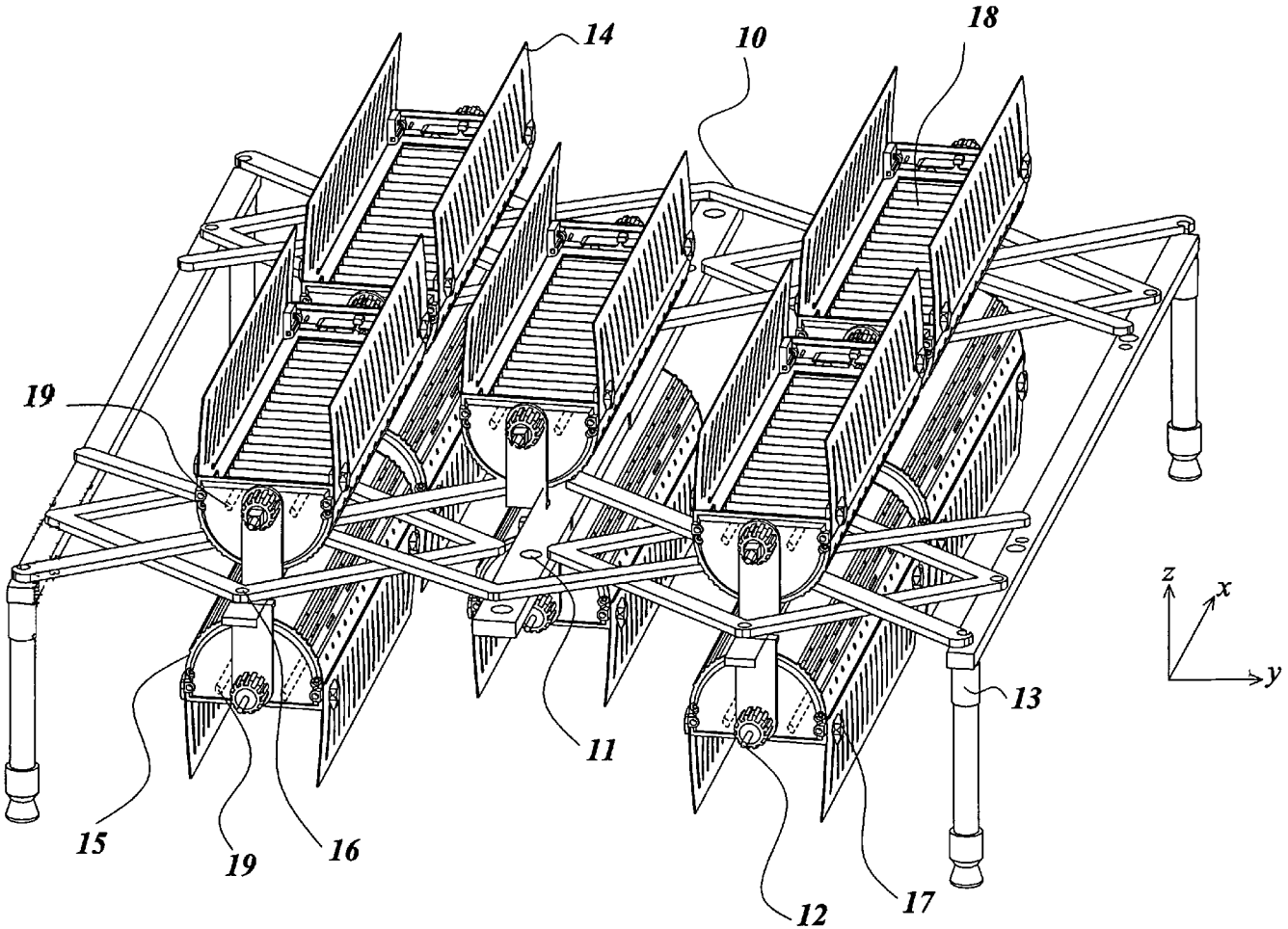
FIG. 3 shows a flexible heating system in the closed condition. Other flexible heating systems are similarly envisaged.

FIG. 3 shows the flexible system with a flexible frame (overall figure) and modules 15 with swivels. Note the x, y, and z axes shown in the figure. These axes are consistent in the figures to follow. The swivel points are typically where rotation is possible. Note modules radiate in one direction and swivel points are on the other side of the module or on the side as shown. 11 and 16 show the typical 360 degree swivel points (better illustrated in FIG. 4) and the 180 degree swivel point is shown in 12. the flexible frame 10 allows the multiple units to retract and expand in order to allow any in-plane swivel. 13 is a post that allows the entire system to be placed in a stable fashion. 14 are flaps which can also swivel. The flaps 14 may be used to deflect energy and also not allow energy to escape. The swiveling of the flaps is controlled by the flap adjusters 17. The flaps swivel on the x-axis and in the same manner may swivel on the y-axis once the modules 15 are rotated. 19 are the (heaters) also called bulbs (inside the module) and define the bulb or heater axis plane (which could be any axis on the x-y plane).

Figure 4:
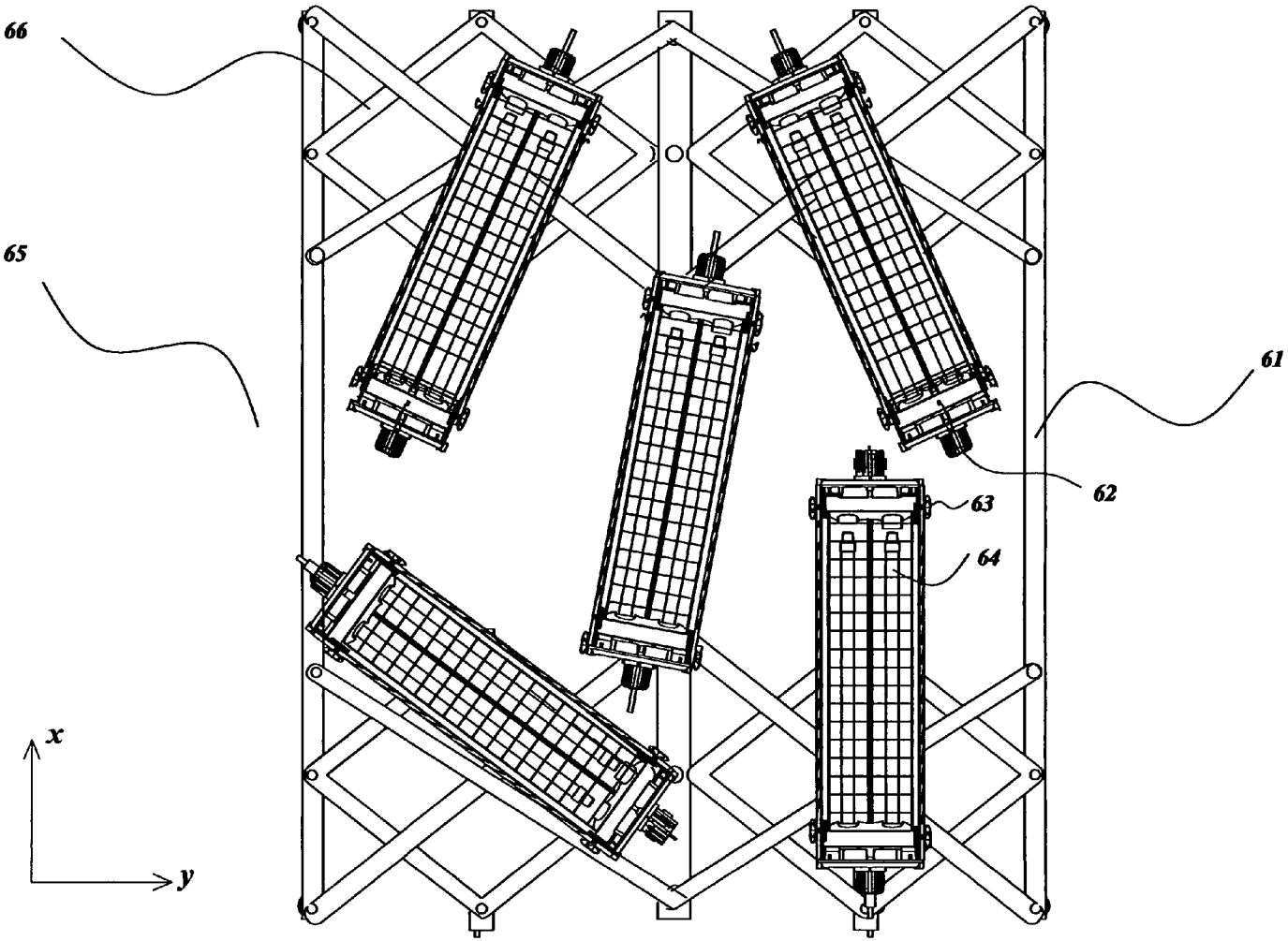
FIG. 4 shows a flexible heating system in the open condition. The plane of the paper is the plane of the die to be heated. Note that both up and down heating (i.e. radiating in front or back of the plane of the paper) are possible in this configuration and the modules may be positioned for heating also 90 degrees to the up down plane axis. Each module may turn 180 degrees in the sideways direction (i.e. rotate on any axis that lies in the plane of the paper) and 360 degrees in its plane. The flexible mesh may contour around bends easily.

FIG. 4 shows typical rotation of the entire assembly 65 along the plane normal to the bulb 64 axis (which in this figure is any axis which lies on the x-y plane). In this figure, 61 is the frame, 62 is a swivel point, 63 is the flap swivel point, 64 is the bulb and 65 is the flexible frame which can move around other swivel points in order to accommodate module rotation as shown in the overall assembly 65.

Figure 5:
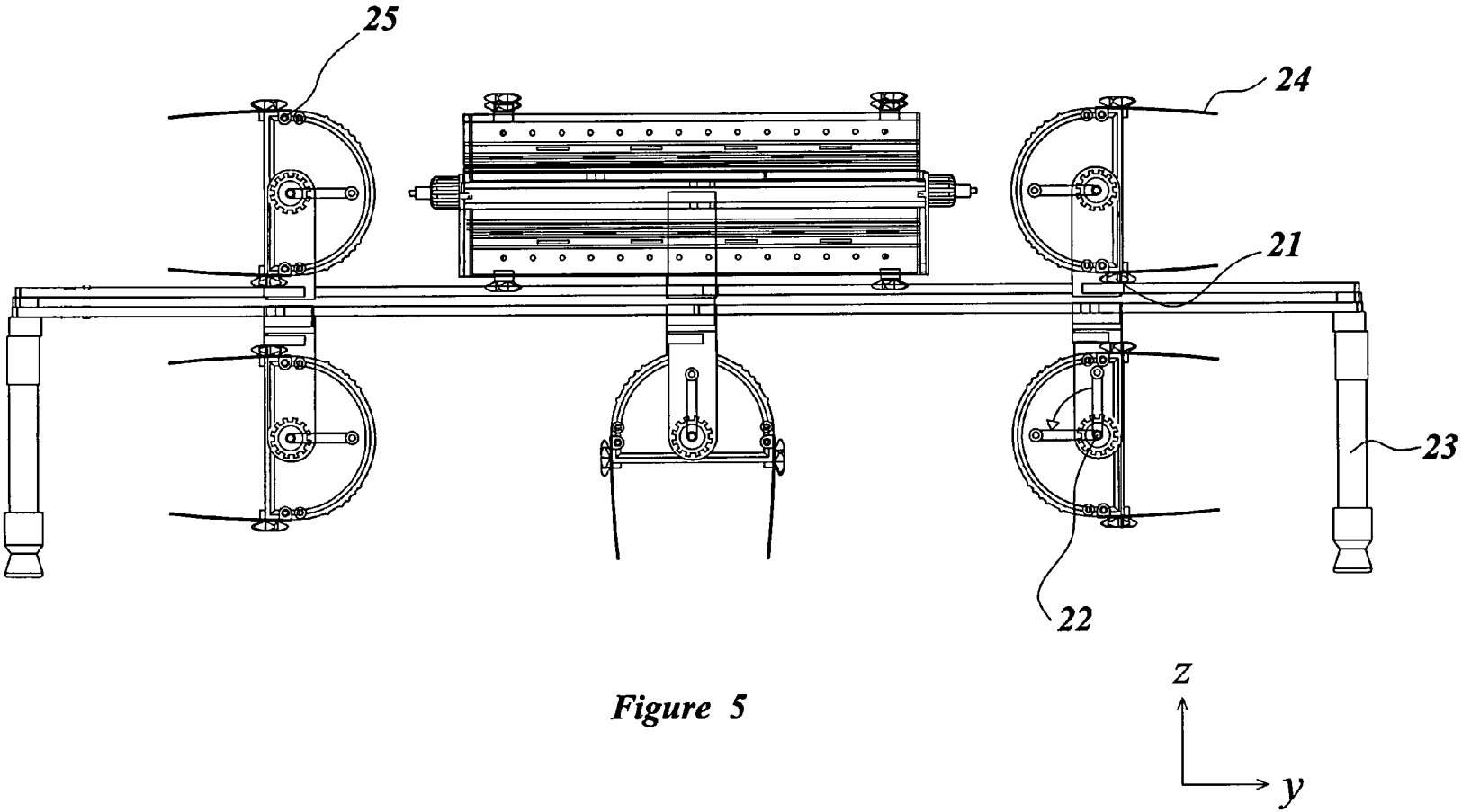
FIG. 5 shows the flexible frame allows for the 360° rotation as well as the 180° rotation.
Figure 7:
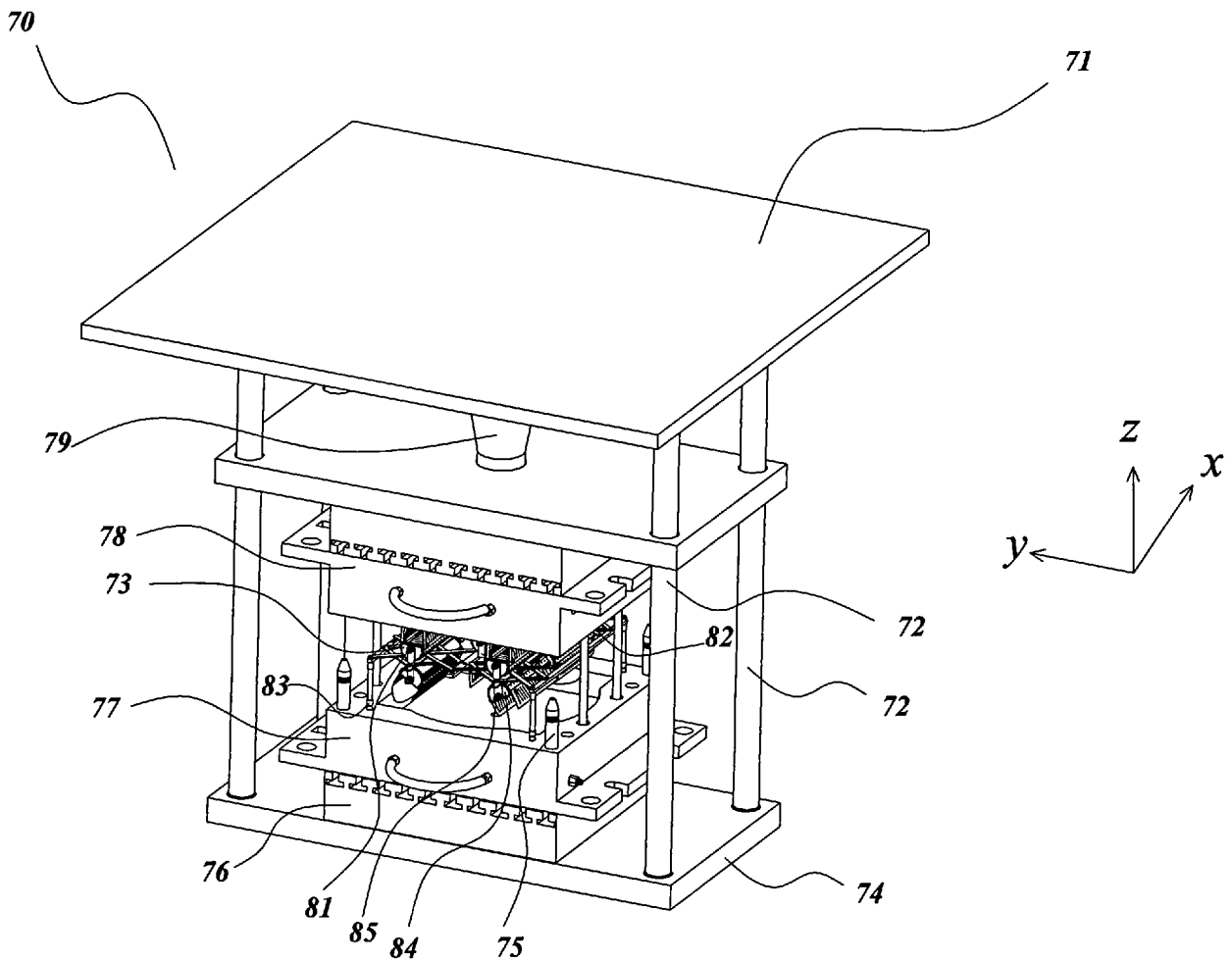
FIG. 7 shows the location of a flexible die heater inside a two side complex die used for forging or low pressure die casting.

FIG. 5, illustrates the unique total flexibility of the figure to be able to hug a complex surface shown in FIG. 7. In FIG. 5, the various key features show 22 a swivel point, 23 is the post, 21 is a flap swivel point, 24 is the flap and 25 is a single module. Note again a 360° swivel is allowed around the z-axis and a 180°swivel is possible about the y-axis (or z-axis which is normal to the plane of the paper).

Figure 6:
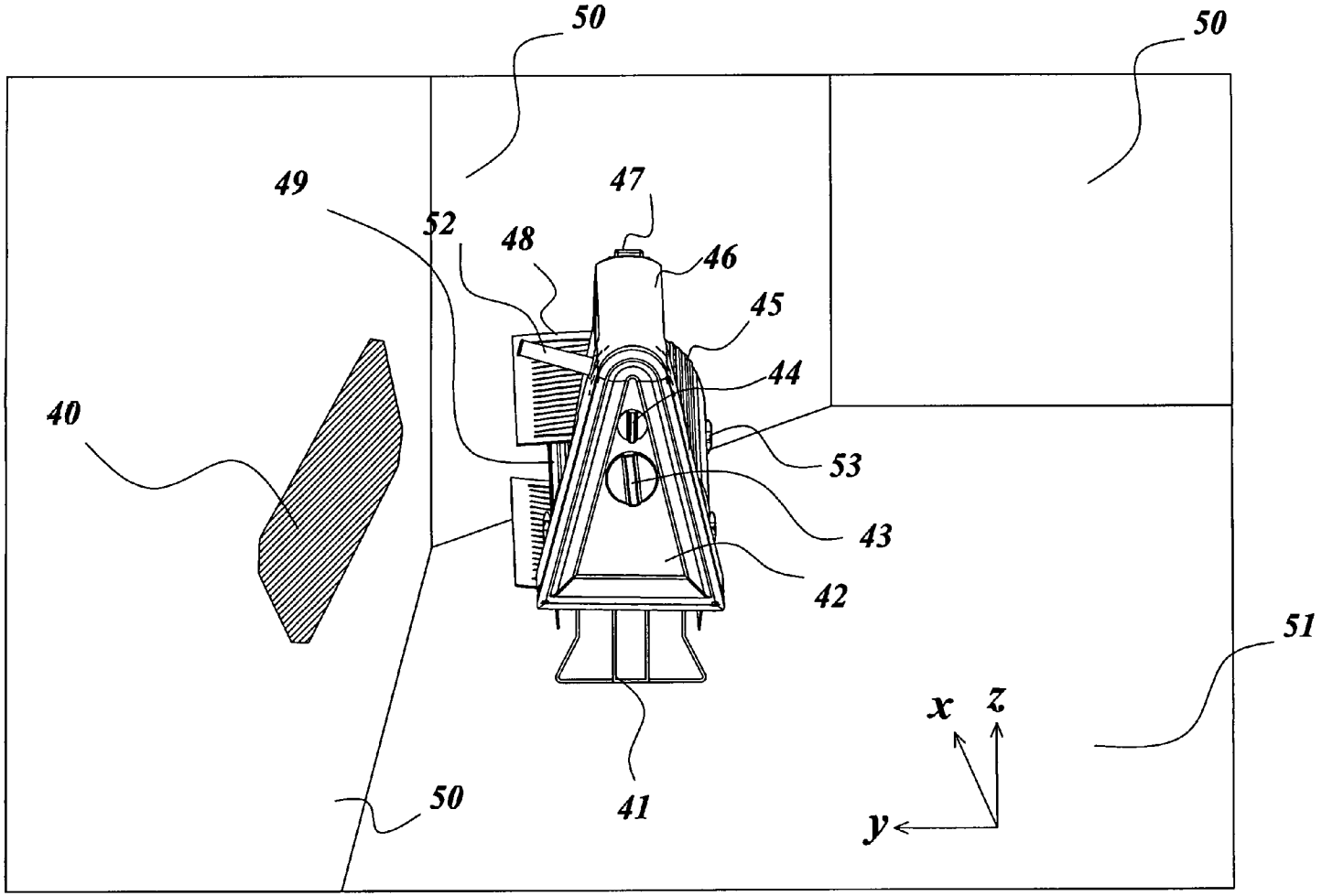
FIG. 6 shows the flexible wire frame which allows the rotation for a module around a 180° swivel point (i.e. along an axis which is normal to the plane of the paper) to heat a wall, with the flexible flaps in open condition.

FIG. 6 highlights how the swiveling and flexible frame on a single module feature may be used for heating walls 50, or floors 51, which are at an angle to each other. This is a typical paint remover configuration. 40 is the heated area on the wall 50. 43 is a knob (also swivel point) which is used for swiveling the module 53 about the x-axis. For a single module as shown, in FIG. 6, 42 is the base, 41 is the retractable or expandable frame, 46 is the handle 47 is a electrical switch, 48 is a post through which electrical feed through of wires is possible, 48 is the flap (which can also swivel about the x-axis), 53 is the flap holder and swivel point, 44 is an high-low power switch. The IR heater namely bulbs 49 can barely be seen in this view and lie along the x-axis. (The x-y plane is the floor 51). Z is the vertical axis.

FIG. 7 shows an overall die press assembly 70. The x-y plane is the plane of the platens. 79 is the press shaft on the die plate leveler 71. The die post 72 and the die platter 74 along with the lower and upper die 77 and 78 align with the help of the guide 75. The IR heater assembly 73 with swivel points 81 and 85 and foldable flaps 85 may be used to heat such a complex die press assembly 70. The IR heater posts 81 and frame 82 allow the swivel points to provide the 180° and 360° flexibility along (i.e. any axis which lies on the x-y plane) and normal to the bulb axis (i.e. the z-axis). The bulb axis in this figure is along the length of the module (the module plane is normal to the z-axis) which are shown in the heater assembly 73.

As clarification we note that as explained in the detailed description of FIG. 3, the x-axis is the heater or bulb length axis and for this figure is also the axis which is parallel to the major dimension of the module. It is understood that by extrapolation that any axis on the x-y plane could have been considered as an equivalent axis. The x-y plane in FIG. 3 is also the plane of heating. In the claims, reference is made to cartesian axes. Cartesian axes are commonly known in the literature. A clear definition is given for example on the web site www.whatis.com. One of the key uniqueness of the invention is that the fully rated power of the apparatus of the invention may be used in all configurations, namely in any tilt condition.

The invention claimed is:

1. An apparatus, comprising:

multiple radiative heaters, each heater is a 2 kilowatt infrared heater; and an adjustable frame;

the adjustable frame being expandable and contractible in one direction in one plane parallel to the radiative heaters, each radiative heater attached to the frame, each radiative heater configured to individually swivel in multiple directions while remaining attached to the frame, and the heaters combined with the frame are adjustable as a unit to provide complete radiative heating in a three dimensional space and each radiative heater individually removable from the adjustable frame, the infrared heaters arranged and affixed in two rows of five on a front of the frame and two more rows of five on a back of the frame.

2. The apparatus of claim 1, wherein each heater is individually attached to the frame via a clamping mechanism allowing bilateral adjustment of each heater.

3. The apparatus of claim 1, wherein each heater is selectively and individually removable from the frame to provide different configurations of the apparatus.

* * * * *